US012577707B2

(12) United States Patent
Muraoka et al.

(10) Patent No.: US 12,577,707 B2
(45) Date of Patent: Mar. 17, 2026

(54) ARTIFICIAL HAIR FIBER

(71) Applicant: DENKA COMPANY LIMITED, Tokyo (JP)

(72) Inventors: Takashi Muraoka, Tokyo (JP); Yuki Sagara, Chuo-ku (JP)

(73) Assignee: Denka Company Limited, Tokyo (JP)

( * ) Notice: Subject to any disclaimer, the term of this patent is extended or adjusted under 35 U.S.C. 154(b) by 341 days.

(21) Appl. No.: 18/006,805

(22) PCT Filed: Jun. 30, 2021

(86) PCT No.: PCT/JP2021/024657
§ 371 (c)(1),
(2) Date: Jan. 25, 2023

(87) PCT Pub. No.: WO2022/030147
PCT Pub. Date: Feb. 10, 2022

(65) Prior Publication Data

US 2024/0271332 A1 Aug. 15, 2024

(30) Foreign Application Priority Data

Aug. 7, 2020 (JP) ..... 2020-134401

(51) Int. Cl.

| | |
|---|---|
| ***D01F 1/10*** | (2006.01) |
| ***A41G 3/00*** | (2006.01) |
| ***D01F 6/48*** | (2006.01) |
| ***D01F 6/90*** | (2006.01) |
| ***D06M 13/188*** | (2006.01) |
| ***D06M 13/224*** | (2006.01) |

(52) U.S. Cl.
CPC ..... *D01F 6/90* (2013.01); *A41G 3/0083* (2013.01); *D01F 1/10* (2013.01); *D01F 6/48* (2013.01); *D06M 13/188* (2013.01); *D06M 13/224* (2013.01)

(58) Field of Classification Search
CPC ..... D01F 1/10; D06M 13/188; D06M 13/224; A41G 3/00; A41G 3/0083; A63H 3/44
See application file for complete search history.

(56) References Cited

U.S. PATENT DOCUMENTS

| | | | | | |
|---|---|---|---|---|---|
| 2,597,708 | A * | 5/1952 | Cresswell | D06M 13/224 | 252/8.84 |
| 3,503,880 | A * | 3/1970 | Mcmicken | D06M 13/292 | 252/8.84 |
| 5,370,804 | A * | 12/1994 | Day | D06M 15/643 | 252/8.84 |
| 5,683,814 | A * | 11/1997 | Kakita | D01D 5/253 | 428/397 |
| 6,139,764 | A | 10/2000 | Hutte | | |
| 2005/0223960 | A1* | 10/2005 | Ganem | D04B 21/16 | 112/475.01 |
| 2008/0139705 | A1* | 6/2008 | Adachi | D01D 5/253 | 524/80 |
| 2009/0260649 | A1 | 10/2009 | Sakurai et al. | | |
| 2013/0298924 | A1* | 11/2013 | Hashimoto | D01F 6/10 | 525/190 |
| 2014/0308505 | A1* | 10/2014 | Schmitt | D01F 1/07 | 428/221 |
| 2015/0090658 | A1* | 4/2015 | Branham | D04H 1/728 | 428/394 |
| 2018/0258556 | A1 | 9/2018 | Bauerfeind | | |

FOREIGN PATENT DOCUMENTS

| | | | |
|---|---|---|---|
| CN | 1231318 | A | 10/1999 |
| CN | 101089260 | A | 12/2007 |
| CN | 101597864 | A | 12/2009 |
| CN | 106884225 | A | 6/2017 |
| CN | 107489029 | A | 12/2017 |
| CN | 108138370 | A | 6/2018 |
| CN | 109154131 | A | 1/2019 |
| GB | 388427 | A | 2/1993 |
| JP | 2002-030571 | A | 1/2002 |
| JP | 2007-332468 | A | 12/2007 |
| JP | 2008-007891 | A | 1/2008 |
| JP | 2010-100966 | A | 5/2010 |
| JP | 2011-168716 | A | 9/2011 |
| JP | 2011-184831 | A | 9/2011 |
| JP | 2016-160549 | A | 9/2016 |
| JP | 2016-211130 | A | 12/2016 |
| JP | 2020-093253 | A | 6/2020 |
| WO | WO2008/010515 | A | 1/2008 |

* cited by examiner

*Primary Examiner* — Jennifer A Gillett
(74) *Attorney, Agent, or Firm* — CHRISTENSEN O'CONNOR JOHNSON KINDNESS PLLC

(57) ABSTRACT

An artificial hair fiber comprising a synthetic resin fiber; and one or more compounds selected from the group consisting of palmitic acid, a palmitate, palmitic acid glyceride, stearic acid, a stearate, and stearic acid glyceride, adhering to the synthetic resin fiber, wherein a total content of the compound is 0.05 wt % or more and less than 0.15 wt % based on a total amount of the artificial hair fiber.

5 Claims, No Drawings

ARTIFICIAL HAIR FIBER

CROSS-REFERENCES TO RELATED APPLICATIONS

This application is a National Stage of International Application No. PCT/JP2021/024657 filed Jun. 30, 2021, which claims the benefit of Japanese Application No. 2020-134401, as filed on Aug. 7, 2020, the disclosures of which are incorporated herein in their entirety.

TECHNICAL FIELD

The present invention relates to a fiber used for artificial hair such as wigs, hair wigs, and false hair attachable to and detachable from the head (hereinafter simply referred to as an "artificial hair fiber").

BACKGROUND ART

Artificial hair fibers used for hair products are subjected to various treatments such as improving slipperiness, providing antistatic properties, or improving glossiness, in order to make synthetic resin fibers close to human hair. For example, Patent Literature 1 discloses a predetermined fiber treating agent for the purpose of the improvement of antistatic properties and slippage and the reduction of stickiness.

CITATION LIST

Patent Literature

Patent Literature 1: Japanese Patent Laid-Open No. 2011-184831

SUMMARY OF INVENTION

Technical Problem

In some applications, artificial hair fibers are woven in and used for a long time. Such hair ornament products are widespread as familiar means of fashion and are supplied to the whole world including particularly Africa. However, it has been found that a problem is that consumers of the hair ornament products cannot frequently wash the hair in some cases depending on the lifestyle, and itchy feeling on the scalp, etc., occurs on that occasion.

The present invention has been made in view of the problem, and it is an object of the present invention to provide an artificial hair fiber with which an itch on the scalp can be reduced.

Solution to Problem

The present invention has been made in view of the problem, and it has been found that the problem can be solved by adjusting the treatment amount of a predetermined fiber treating agent component, leading to the completion of the present invention.

That is, the present invention is as follows.

[1]

An artificial hair fiber comprising:

a synthetic resin fiber; and one or more compounds selected from the group consisting of palmitic acid, a palmitate, palmitic acid glyceride, stearic acid, a stearate, and stearic acid glyceride, adhering to the synthetic resin fiber, wherein a total content of the compound is 0.05 wt % or more and less than 0.15 wt % based on a total amount of the artificial hair fiber.

[2]

The artificial hair fiber according to [1], wherein the compound comprises at least one or more stearic acid compounds selected from the group consisting of stearic acid, a stearate, and stearic acid glyceride, and a content of the stearic acid compounds is less than 0.15 wt % based on the total amount of the artificial hair fiber.

[3]

The artificial hair fiber according to [1] or [2], wherein the palmitate is a sodium palmitate salt, and the stearate is a sodium stearate salt.

[4]

The artificial hair fiber according to any one of to [3], wherein the synthetic resin fiber is a fiber comprising a vinyl chloride resin, or a fiber comprising a polyamide resin.

[5]

An artificial hair fiber wherein a component solubilized in methanol includes one or more compounds selected from the group consisting of palmitic acid, a palmitate, palmitic acid glyceride, stearic acid, a stearate, and stearic acid glyceride, and a content of the compound is 0.05 wt % or more and less than 0.15 wt % based on a total amount of the artificial hair fiber.

[6]

The artificial hair fiber according to [5], being a fiber comprising a vinyl chloride resin, or a fiber comprising a polyamide resin.

[7]

The artificial hair fiber according to [5] or [6], wherein the compound comprises at least one or more stearic acid compounds selected from the group consisting of stearic acid, a stearate, and stearic acid glyceride.

[8]

The artificial hair fiber according to any one of to [7], wherein the palmitate is a sodium palmitate salt, and the stearate is a sodium stearate salt.

Advantageous Effect of Invention

According to the present invention, an artificial hair fiber with which an itch on the scalp can be reduced can be provided.

DESCRIPTION OF EMBODIMENT

An embodiment of the present invention (hereinafter referred to as "this embodiment") will be described in detail below, but the present invention is not limited to this, and various modifications can be made without departing from the spirit thereof.

[Artificial Hair Fiber]

The artificial hair fiber of this embodiment includes a synthetic resin fiber; and one or more compounds selected from the group consisting of palmitic acid, a palmitate, palmitic acid glyceride, stearic acid, a stearate, and stearic acid glyceride (hereinafter also referred to as "particular compounds"), adhering to the synthetic resin fiber, and the total content of the compound is 0.05 wt % or more and less than 0.15 wt % based on the total amount of the artificial hair fiber.

In this embodiment, by specifying a predetermined particular compound and defining the upper limit of its total content, an itch felt when a hair ornament product using an artificial hair fiber is worn, and the like can be reduced. On the other hand, by defining the lower limit of the total content of the particular compound, the quality of the artificial hair fiber can be maintained without impairing more than necessary the slipperiness and other effects achieved by the particular compound. The configuration of the artificial hair fiber of this embodiment will be described in detail below.

[Synthetic Resin Fiber]

The synthetic resin fiber is not particularly limited, and examples thereof include a fiber comprising a vinyl chloride resin, a polyethylene resin fiber, a fiber comprising a polyamide resin, a fiber comprising a polyester resin, and a fiber comprising ethylene vinyl alcohol. Among these, a fiber comprising a vinyl chloride resin and a fiber comprising a polyamide resin are preferred. By using such fibers, the qualities such as processability and feel tend to improve more. The artificial hair fiber of this embodiment may include one fiber, or two or more fibers of different materials may be mixed and used.

The "fiber comprising a resin" includes, in addition to a fiber comprising a predetermined resin simple substance, one obtained by forming a composition including a predetermined resin, and additives added as needed, in the form of a fiber by a production method as described later.

The vinyl chloride resin is not particularly limited, and examples thereof include homopolymer resins that are homopolymers of vinyl chloride, and various copolymer resins. One vinyl chloride resin may be used alone, or two or more vinyl chloride resins may be used in combination.

The copolymer resin for the vinyl chloride resin is not particularly limited, and examples thereof include copolymer resins of vinyl chloride and vinyl esters, such as vinyl chloride-vinyl acetate copolymer resins and vinyl chloride-vinyl propionate copolymer resins; copolymer resins of vinyl chloride and acrylates, such as vinyl chloride-butyl acrylate copolymer resins and vinyl chloride-2-ethylhexyl acrylate copolymer resins; copolymer resins of vinyl chloride and olefins, such as vinyl chloride-ethylene copolymer resins and vinyl chloride-propylene copolymer resins; vinyl chloride-acrylonitrile copolymer resins, mixtures of vinyl chloride resins and chlorinated vinyl chloride resins, and vinyl chloride-acrylonitrile copolymers.

Among these, mixtures of vinyl chloride resins and chlorinated vinyl chloride resins and vinyl chloride-acrylonitrile copolymers are preferred. By using such resins, the qualities such as processability, slipperiness, and feel tend to improve more.

The polyamide resin is not particularly limited, and examples thereof include nylon 6, nylon 66, nylon 11, nylon 12, nylon 6-10, nylon 6-12, or copolymers thereof. One polyamide resin may be used alone, or two or more polyamide resin resins may be used in combination.

Among these, nylon 6, nylon 66, and copolymers of nylon 6 and nylon 66 are preferred. By using such resins, the qualities such as processability, slipperiness, and feel tend to improve more.

[Particular Compound]

The artificial hair fiber of this embodiment includes one or more particular compounds selected from the group consisting of palmitic acid, a palmitate, palmitic acid glyceride, stearic acid, a stearate, and stearic acid glyceride. The particular compound adheres to the surface of the artificial hair fiber.

The salt constituting the palmitate and the stearate is not particularly limited, and examples thereof include alkali metals such as lithium, sodium, and potassium; and alkaline earth metals such as magnesium and calcium. Among these, alkali metal salts are preferred, and sodium salts are more preferred. By using a sodium palmitate salt and/or a sodium stearate salt, the itch during wear is more suppressed, and the slipperiness and the feel tend to improve more.

The palmitic acid glyceride and the stearic acid glyceride are not particularly limited, and examples thereof include monoglycerides, diglycerides, and triglycerides. The palmitic acid glyceride and the stearic acid glyceride in this embodiment also include palmitic acid glyceride and stearic acid glyceride in which another fatty acid or another carboxylic acid such as lactic acid is ester-bonded to another hydroxyl group of glycerin, as long as palmitic acid or stearic acid is ester-bonded to glycerin.

Among these, the particular compound preferably includes one or more stearic acid compounds selected from the group consisting of stearic acid, a stearate, and stearic acid glyceride, and stearic acid and a stearate are more preferred. By including such stearic acid compounds, the itch during wear is more suppressed, and the slipperiness and the feel tend to improve more.

The total content of the particular compound is 0.05 wt % or more and less than 0.15 wt % based on the total amount of the artificial hair fiber, preferably 0.07 wt % or more and 0.13 wt % or less based on the total amount of the artificial hair fiber, and further 0.8 wt % or more and 0.12 wt % or less based on the total amount of the artificial hair fiber. When the total content of the particular compound is 0.05 wt % or more, the slipperiness and the feel improve more. When the total content of the particular compound is less than 0.15 wt %, the itch during wear is more suppressed.

In this embodiment, the total content of the particular compound means the total amount of the particular compound. When two or more particular compounds are included, the total content of the particular compound is the content of the total of the two or more particular compounds. When only one particular compound is included, the total content of the particular compound means the content of the compound. The total content of the particular compound can be adjusted, for example, with a treating agent for treating a synthetic fiber.

The content of one or more palmitic acid compounds selected from the group consisting of palmitic acid, a palmitate, and palmitic acid glyceride (hereinafter also simply referred to as "palmitic acid compounds"), among the particular compounds, is preferably less than 0.15 wt %, more preferably 0.01 to 0.10 wt %, and further preferably 0.01 to 0.06 wt % based on the total amount of the artificial hair fiber. When the content of the palmitic acid compounds is within the range, the itch during wear is more suppressed, and the slipperiness and the feel tend to improve more.

The content of the stearic acid compounds, among the particular compounds, is preferably less than 0.15 wt %, more preferably 0.01 wt % or more and less than 0.15 wt %, and further preferably 0.04 wt % or more and less than 0.12 wt % based on the total amount of the artificial hair fiber. When the content of the stearic acid compounds is within the range, the itch during wear is more suppressed, and the slipperiness and the feel tend to improve more.

The total content of the particular compound can be specified from the amount of the component dissolved in methanol by immersing the artificial hair fiber in methanol and drying the methanol after the immersion.

[Other Additives]

In the artificial hair fiber of this embodiment, other additives may be used as needed. Other additives may adhere to the surface of the artificial hair fiber or be mixed into the resin composition constituting the fiber.

Other additives are not particularly limited, and examples thereof include a heat stabilizer and a lubricant. When a compound corresponding to the particular compound adheres to the surface of the artificial hair fiber as a heat stabilizer or a lubricant, its amount is limited to the total content of the particular compound described above.

(Heat Stabilizer)

The heat stabilizer is not particularly limited as long as it is conventionally known. Examples of the heat stabilizer include tin-based heat stabilizers, Ca—Zn-based heat stabilizers, hydrotalcite-based heat stabilizers, epoxy-based heat stabilizers, and β-diketone-based heat stabilizers. Among these, Ca—Zn-based heat stabilizers and hydrotalcite-based heat stabilizers are preferred. By using such heat stabilizers, the product life of an artificial hair product is extended, and the discoloration of the fiber is suppressed, and in addition the thermal decomposition of the composition when the fiber is formed can be suppressed. One heat stabilizer may be used alone, or two or more heat stabilizers may be used in combination.

The tin-based heat stabilizers are not particularly limited, and examples thereof include mercapto tin-based heat stabilizers such as dimethyltin mercapto, dimethyltin mercaptide, dibutyltin mercapto, dioctyltin mercapto, dioctyltin mercapto polymers, and dioctyltin mercapto acetate, maleate tin-based heat stabilizers such as dimethyltin maleate, dibutyltin maleate, dioctyltin maleate, and dioctyltin maleate polymers, and laurate tin-based heat stabilizers such as dimethyltin laurate, dibutyltin laurate, and dioctyltin laurate.

The Ca—Zn-based heat stabilizers are not particularly limited and include zinc stearate, calcium stearate, zinc 12-hydroxystearate, and calcium 12-hydroxystearate.

The hydrotalcite-based heat stabilizers are not particularly limited, and examples thereof include composite salt compounds including magnesium and/or an alkali metal, and aluminum or zinc, composite salt compounds including magnesium and aluminum, and compounds obtained by dehydrating the water of crystallization of these composite salt compounds.

The epoxy-based heat stabilizers are not particularly limited and include epoxidized soybean oil and epoxidized linseed oil.

The β-diketone-based heat stabilizers are not particularly limited and include stearoylbenzoylmethane and dibenzoylmethane.

The content of the heat stabilizer is preferably 0.1 to 5.0 parts by mass, more preferably 1.0 to 3.0 parts by mass, based on 100 parts by mass of the synthetic resin fiber. When the content of the heat stabilizer is within the range, the product life of an artificial hair product is extended, and the discoloration of the fiber is suppressed, and in addition the thermal decomposition of the composition when the fiber is formed tends to be suppressed.

(Lubricant)

The lubricant is not particularly limited as long as it is conventionally known. Examples of the lubricant include metallic soap-based lubricants, higher fatty acid-based lubricants, ester-based lubricants, and higher alcohol-based lubricants. Using such lubricants are also effective for controlling the molten state of the composition and the adhesion states between the composition and the metal surfaces of a screw, a cylinder, a die, and the like in an extruder, in addition to being effective for the touch. One lubricant may be used alone, or two or more lubricants may be used in combination.

The metallic soap-based lubricants are not particularly limited, and, for example, metallic soaps such as stearates, laurates, palmitates, and oleates of Na, Mg, Al, Ca, Ba, and the like are illustrated.

As the higher fatty acid-based lubricants, for example, saturated fatty acids such as stearic acid, palmitic acid, myristic acid, lauric acid, and capric acid, unsaturated fatty acids such as oleic acid, or mixtures thereof are illustrated.

As the higher alcohol-based lubricants, stearyl alcohol, palmityl alcohol, myristyl alcohol, lauryl alcohol, oleyl alcohol, and the like are illustrated.

As the ester-based lubricants, ester-based lubricants including alcohols and fatty acids, pentaerythritol-based lubricants such as monoesters, diesters, triesters, and tetraesters of pentaerythritol or dipentaerythritol and higher fatty acids, or mixtures thereof, and montanic acid wax-based lubricants, esters of montanic acid and higher alcohols such as stearyl alcohol, palmityl alcohol, myristyl alcohol, lauryl alcohol, and oleyl alcohol, are illustrated.

The content of the lubricant is preferably 0.2 to 5.0 parts by mass, more preferably 1.0 to 4.0 parts by mass, based on 100 parts by mass of the synthetic resin fiber. When the content of the lubricant is within the range, die pressure increase, yarn breakage, an increase in nozzle pressure during spinning, and the like can be suppressed, and the production efficiency tends to improve more.

As the additives, in addition to the above, a processing aid, a matting agent, a plasticizer, a reinforcing agent, an ultraviolet absorbing agent, an antioxidant, an antistatic agent, a filler, a flame retardant, a pigment, a coloration improving agent, a conductivity providing agent, a perfume, and the like can be used.

[Method for Producing Artificial Hair Fiber]

Examples of the method for producing the artificial hair fiber of this embodiment is not particularly limited, and examples thereof include a method including the steps of spinning a composition including a resin, and additives as needed, used for the synthetic resin fiber to obtain the synthetic resin fiber, and treating the obtained synthetic resin fiber with a fiber treating agent.

(Preparation of Composition)

The composition to be spun may be a pellet compound obtained by mixing a resin used for the synthetic resin fiber, and additives used as needed, using a Henschel mixer, a super mixer, a ribbon blender, or the like, and melt-mixing the obtained powder compound.

The method for producing the powder compound may be hot blending or cold blending, and as the production conditions, the usual conditions can be used. From the viewpoint of decreasing the volatile matter in the composition, hot blending in which cutting temperature during blending is raised to 105° C. to 155° C. is preferably used.

For the production of the pellet compound, for example, a single-screw extruder, a counter-rotating twin-screw extruder, a conical twin-screw extruder, a corotating twin-screw extruder, Ko-Kneader, a planetary gear extruder, or a kneading machine such as a roll kneading machine can be used.

The conditions when the pellet compound is produced are not particularly limited, but the resin temperature is preferably set to be 185° C. or less in order to prevent the thermal deterioration of the composition. In order to remove metal pieces of the screw, and fibers attached to protective gloves, which can be mixed into the pellet compound in small amounts, a mesh can also be installed near the tip of the screw.

For the production of the pellet compound, a cold cutting method can be adopted. Means for removing chips (a fine powder produced during pellet production) and the like, which can be mixed in cold cutting, can be adopted. When used for a long time, the cutter is chipped, which is likely to generate chips. Therefore, the cutter is preferably appropriately replaced.

(Spinning Step)

In the spinning step, the composition, for example, the pellet compound, obtained as described above can be extruded and melt-spun at a cylinder temperature in the range of 150° C. to 190° C. and a nozzle temperature in the range of 180±15° C. The cross-sectional shape of the nozzle used at this time can be appropriately set according to the cross-sectional shape of the artificial hair fiber to be made.

The undrawn synthetic resin fiber melt-spun from the nozzle is introduced into a heated cylinder (heated cylinder temperature 250° C.) and instantaneously heat-treated and can be wound by a take-up machine installed at a position about 4.5 m directly below the nozzle. In this winding, the take-up speed can be adjusted so that the fineness of the undrawn yarn is the desired thickness.

When a polyvinyl chloride-based resin composition is formed into an undrawn yarn, a conventionally known extruder can be used. For example, a single-screw extruder, a counter-rotating twin-screw extruder, or a conical twin-screw extruder can be used.

(Drawing and Heat Treatment)

The undrawn synthetic resin fiber obtained as described above can be subjected to drawing treatment and subjected to heat treatment. As one example, the undrawn synthetic resin fiber is drawn by a factor of 3 by a drawing machine (under an air atmosphere at 105° C.) and then subjected to heat treatment by a factor of 0.75 (heat-shrunk until the fiber total length shrinks to 75% of the length before the treatment) using a heat-treating machine (under an air atmosphere at 110° C.) so that the fineness is 58 to 62 denier, and the artificial hair fiber can be made.

(Gear Processing)

Further, the artificial hair fiber obtained as described above may be gear-processed as needed. The gear processing is a method of crimping a fiber bundle by passing it between two engaging high temperature gears, and the material of the gears used, the shape of the number of teeth of the gears, the fractions of the gears, and the like are not particularly limited. The wave shape of the crimp can change by the fiber material, the fineness, the condition of the pressure between the gears, and the like, but the wave shape of the crimp can be controlled by the depth of the grooves of the gear wave shape, the surface temperature of the gears, and the processing speed.

The gear processing conditions are not particularly limited, but preferably, the depth of the grooves of the gear wave shape is 0.2 mm to 6 mm, more preferably 0.5 mm to 5 mm, the surface temperature of the gears is 30 to 100° C., more preferably 40 to 80° C., and the processing speed is 0.5 to 10 m/min, more preferably 1.0 to 8.0 m/min.

(Surface Treatment)

The obtained synthetic resin fiber can be treated with a fiber treating agent at any stage after the spinning step. Thus, optional additives can be applied to the surface of the synthetic resin fiber. The fiber treating agent may include a solvent and the above-described various additives. For example, as the fiber treating agent, one including a predetermined amount of the particular compound can be used.

For the application of the fiber treating agent, conventionally known means for applying a liquid to a fiber can be used. Examples of the means include means for applying the fiber treating agent to the artificial hair fiber by a roll having a surface to which the fiber treating agent adheres (roll transfer method); means for immersing a substrate fiber in a liquid tank in which the fiber treating agent is stored; and means for adhering the fiber treating agent to a substrate fiber via an application tool such as a brush or a dauber.

Another Aspect

The artificial hair fiber in which the particular compound adheres to the synthetic resin fiber has been described above, but as described above, there is also an aspect in which the particular compound is included in the composition constituting the synthetic resin fiber, instead of adhering to the synthetic resin fiber, or adheres to the synthetic resin fiber and is included in the composition constituting the synthetic resin fiber.

As such another aspect of this embodiment, a description will be given for an artificial hair fiber wherein the component solubilized in methanol includes one or more compounds selected from the group consisting of palmitic acid, a palmitate, palmitic acid glyceride, stearic acid, a stearate, and stearic acid glyceride, and the content of the compound is 0.05 wt % or more and less than 0.15 wt % based on the total amount of the artificial hair fiber.

The artificial hair fiber in the aspect is composed of a synthetic resin fiber in the same manner as above, and the content of the particular compound is defined as the component solubilized in methanol. Thus, in the solubilized component, in addition to the particular compound adhering to the surface, the particular compound that can be extracted from the fiber as the solubilized component is included. The particular compound that can be extracted from the fiber as the solubilized component may also be a cause of an itch and the like by long time use.

In another aspect, the synthetic resin fiber, the particular compound, and the optional additives can be the same as above. The method for producing the artificial hair fiber can also be the same as above.

The method for measuring the component solubilized in methanol is as follows. First, 10 g of the artificial hair fiber is taken in a 200 ml screw tube, 100 ml of methanol is placed in the screw tube, and the screw tube is inverted five times for mixing, followed by standing and immersion at ordinary temperature for 1 h or more. Subsequently, the extracted liquid is placed in another 200 ml screw tube, followed by nitrogen blowing and drying at 40° C. Then, the dried material is analyzed by a known method, and thus the component included in the solubilized component and its amount can be specified. Here, the known analysis method is not particularly limited, and examples thereof include NMR, IR, GPC, and various MS.

[Products Using Artificial Hair Fiber]

The artificial hair fiber of this embodiment can be preferably used as head ornaments such as hair wigs, hairpieces, braids, and extension hair.

EXAMPLES

The present invention will be more specifically described below using Examples and Comparative Examples. The present invention is not limited in any way by the following Examples.

[Production of Artificial Hair Fiber]

1. Preparation of Fiber Treating Agent

Components shown in Table 1 were blended in amounts blended (parts by mass) shown in the same table to obtain a fiber treating agent. As the components, the following were used.

Na stearate: TOKYO CHEMICAL INDUSTRY CO., LTD./S0081

Na palmitate: TOKYO CHEMICAL INDUSTRY CO., LTD./P0007

Stearic acid: FUJIFILM Wako Pure Chemical Corporation

Palmitic acid: FUJIFILM Wako Pure Chemical Corporation

Stearic acid glyceride: Kao Corporation/EXCEL 5-95

Palmitic acid glyceride: Kao Corporation/EXCEL VX-95

2. Preparation of Synthetic Resin Fiber

As the synthetic resin fiber used for the production of an artificial hair fiber, the following vinyl chloride-based fiber was used. The average fineness of the fiber was 55 to 70 dtex. The average fineness was obtained by the average of measured values with N=100.

Vinyl chloride-based fiber: polyvinyl chloride (TAIYO VINYL CORPORATION: TH-700) was spun in the form of a fiber and used 3. Application of Fiber Treating Agent For the Examples and the Comparative Examples, after drawing was completed in the process for producing the synthetic resin fiber, the fiber treating agent was applied to the surface of the fiber by a roll transfer method to obtain an artificial hair fiber. The amounts of the adhering active components of the fiber treating agent adhering to the artificial hair fiber are shown in Table 1.

4. Amounts of Components Adhering 10 g of the artificial hair fiber produced as described above was taken in a 200 ml screw tube, 100 ml of methanol was placed in the screw tube, and the screw tube was inverted five times for mixing, followed by standing and immersion at ordinary temperature for 1 h or more. Subsequently, the extracted liquid was placed in another 200 ml screw tube, followed by nitrogen blowing and drying at 40° C. The total amount of the solubilized components was calculated. Then, the solubilized components were specified using NMR (AVANCE 111500: manufactured by Bruker) and LC-MS (Agilent 1100: manufactured by Agilent Technology). From the specified solubilized components, the amounts of palmitic acid or the Na salt thereof and stearic acid or the Na salt thereof adhering were obtained. The synthetic resin fiber used in the present Examples includes no additives other than the components applied with the fiber treating agent, and therefore the solubilized components have the same meaning as the total content of the particular compounds adhering to the synthetic resin fiber.

[Evaluation of Itchiness]

For the evaluation of itchiness, 10 subjects wore 400 g of each of hair products made using the artificial hair fibers of the Examples and the Comparative Examples for 24 h and evaluated according to the following evaluation criteria:

◎: the proportion of subjects who do not feel an itch on the scalp is 90% or more and 100% or less ○: the proportion of subjects who do not feel an itch on the scalp is 70% or more and less than 90%

Δ: the proportion of subjects who do not feel an itch on the scalp is 50% or more and less than 70% x: the proportion of subjects who do not feel an itch on the scalp is less than 50%

[Evaluation of Slipperiness]

For the evaluation of slipperiness, each of the artificial hair fibers of the Examples and the Comparative Examples was bundled with a length of 250 mm and a weight of 20 g and evaluated by determination by the touch of 10 artificial hair fiber treatment engineers (practical experience 5 or more years) according to the following evaluation criteria:

◎: a fiber bundle that all engineers evaluated as having no catch and having good slipperiness ○: the proportion of engineers who evaluated the fiber bundle as having no catch and having good slipperiness is 90% or more and less than 100%

Δ: the proportion of engineers who evaluated the fiber bundle as having no catch and having good slipperiness is 70% or more and less than 90% x: the proportion of engineers who evaluated the fiber bundle as having no catch and having good slipperiness is less than 70%

TABLE 1

| | | Examples | | | | | | | | | Comparative Examples | | |
|---|---|---|---|---|---|---|---|---|---|---|---|---|---|
| | | 1 | 2 | 3 | 4 | 5 | 6 | 7 | 8 | 9 | 1 | 2 | 3 |
| Composition of fiber treating agent | Water (wt %) | 88 | 84 | 80 | 87 | 74 | 80 | 87 | 80 | 87 | 71 | 72 | 96 |
| | Na stearate (wt %) | 6 | 8 | 10 | 0 | 13 | | | | | 0 | 13 | 2 |
| | Na palmitate (wt %) | 6 | 8 | 10 | 13 | 13 | 10 | | 10 | | 29 | 15 | 2 |
| | Stearic acid (wt %) | | | | | | 10 | | | | | | |
| | Palmitic acid (wt %) | | | | | | | 13 | | | | | |
| | Stearic acid glyceride (wt %) | | | | | | | | 10 | | | | |
| | Palmitic acid glyceride (wt %) | | | | | | | | | 13 | | | |
| | Fiber | Vinyl chloride-based fiber | | | | | | | | | | | |
| Content of particular compounds | Stearic acid, stearic acid glyceride, or Na salts thereof | 0.03 | 0.04 | 0.05 | — | 0.07 | 0.05 | — | 0.05 | — | — | 0.07 | 0.01 |
| | Palmitic acid, palmitic acid glyceride, or Na salts thereof | 0.03 | 0.04 | 0.05 | 0.07 | 0.07 | 0.05 | 0.07 | 0.05 | 0.07 | 0.15 | 0.08 | 0.01 |
| Evaluation | Itchiness | ◎ | ◎ | ◎ | ○ | Δ | ◎ | ○ | ○ | Δ | X | X | ◎ |
| | Slipperiness | Δ | ○ | ◎ | ○ | ◎ | ○ | Δ | ◎ | ○ | ◎ | ◎ | X |

INDUSTRIAL APPLICABILITY

The present invention has industrial applicability as an artificial hair fiber used for artificial hair such as wigs, hair wigs, and false hair attachable to and detachable from the head.

The invention claimed is:

1. An artificial hair fiber comprising:

a synthetic resin fiber having a fineness of between about 55 dtex and about 70 dtex; and one or more compounds selected from the group consisting of a palmitate and a stearate adhering to the synthetic resin fiber, wherein the palmitate is a sodium palmitate salt, and the stearate is a sodium stearate salt, wherein the synthetic resin fiber comprises a vinyl chloride resin, a polyethylene resin, or an ethylene alcohol (EVOH) resin, and wherein a total content of the compound is 0.05 wt % or more and less than 0.15 wt % based on a total amount of the artificial hair fiber.

2. The artificial hair fiber according to claim 1, wherein a content of the stearic acid compounds is less than 0.15 wt % based on the total amount of the artificial hair fiber.

3. The artificial hair fiber according to claim 1, wherein the synthetic resin fiber is a fiber comprising a vinyl chloride resin.

4. An artificial hair fiber comprising:

a component solubilized in methanol comprising one or more compounds selected from the group consisting of a palmitate and a stearate, wherein the palmitate is a sodium palmitate salt and the stearate is a sodium stearate salt, wherein the synthetic resin fiber comprises a vinyl chloride resin, a polyethylene resin, or an ethylene alcohol (EVOH) resin, and wherein a content of the compound is 0.05 wt % or more and less than 0.15 wt % based on a total amount of the artificial hair fiber.

5. The artificial hair fiber according to claim 4, being a fiber comprising a vinyl chloride resin.

* * * * *